US005190454A

United States Patent [19]

Murray et al.

[11] Patent Number: 5,190,454

[45] Date of Patent: Mar. 2, 1993

[54] ELECTRONIC COMBUSTION CONTROL SYSTEM

[75] Inventors: Stuart W. Murray, Edmond; Kenneth D. Cosby, Del City, both of Okla.

[73] Assignee: CMI Corporation, Oklahoma City, Okla.

[21] Appl. No.: 731,080

[22] Filed: Jul. 15, 1991

[51] Int. Cl.[5] ..... F27B 7/00

[52] U.S. Cl. ..... 432/103; 431/12; 431/76; 431/89; 431/354

[58] Field of Search ..... 431/76, 12, 10, 354, 431/89; 432/103

[56] References Cited

U.S. PATENT DOCUMENTS

| | | | |
|---|---|---|---|
| 3,577,648 | 5/1971 | Brock | 34/9 |
| 3,614,071 | 10/1971 | Brock | 259/147 |
| 3,693,945 | 9/1972 | Brock | 259/146 |
| 3,809,373 | 5/1974 | Brock | 259/154 |
| 4,043,742 | 8/1977 | Egan et al. | 431/12 |
| 4,174,949 | 11/1979 | Swisher, Jr. | 432/58 |
| 4,260,363 | 4/1981 | Cratin, Jr. | 431/76 |
| 4,293,228 | 10/1981 | Swisher, Jr. | 366/25 |
| 4,359,950 | 11/1982 | Leffler et al. | 431/76 |
| 4,375,950 | 3/1983 | Durley, III | 431/76 |
| 4,787,938 | 11/1988 | Hawkins | 106/281.1 |
| 4,910,540 | 3/1990 | Murray | 366/7 |
| 4,913,552 | 4/1990 | Bracegirdle | 366/4 |
| 4,919,538 | 4/1990 | Swisher, Jr. | 366/4 |
| 4,989,986 | 2/1991 | Swisher, Jr. | 366/4 |
| 4,994,959 | 2/1991 | Ovenden et al. | 431/12 |

FOREIGN PATENT DOCUMENTS

| | | | |
|---|---|---|---|
| 0083479 | 7/1983 | European Pat. Off. | 431/76 |
| 0043120 | 3/1982 | Japan | 431/76 |

OTHER PUBLICATIONS

Pub. ABX301, 1989, "CMI-Impulse Plant Management Control System".

"The Fundamentals of the Operation and Maintenance of the Exhaust".

*Primary Examiner*—A. Michael Chambers

*Attorney, Agent, or Firm*—Dunlap, Codding, Lee

[57] ABSTRACT

An apparatus and method for adjusting the air-fuel ratio of a burner in order to minimize the presence of undesirable emissions in exhaust gases of the burner combustion. A burner calibration is performed by selecting a number of calibration points corresponding to burner fuel positions. Air flow is varied for each calibration point as an exhaust gas analyzer determines the content of exhaust gases of the burner combustion. Air settings for optimal combustion are determined for each calibration point and are stored in a programmable logic controller and software. During plant operation, the programmable logic controller and software adjust the air supplied to the combustion of the burner according to the calibration data and the fuel position of the burner.

9 Claims, 2 Drawing Sheets

Microfiche Appendix Included
(15 Microfiche, 1 Pages)

ELECTRONIC COMBUSTION CONTROL SYSTEM

REFERENCE TO MICROFICHE APPENDIX

The software which monitors and controls the burner combustion and other functions of an asphalt production plant is hereby incorporated in a microfiche appendix containing a total of 1 microfiche and a total of 15 frames.

BACKGROUND OF THE INVENTION

1. Field of the Invention

The present invention relates to an apparatus and method for monitoring and controlling combustion in a burner, and, particularly, in a burner of an asphalt production plant.

2. Prior Art

The use of electronic hardware and software to control and monitor the the components of asphalt production plants is well-known in the industry. Various systems have been developed to provide information concerning production stack and mix designs, silo mix inventory, mix and material flow rates, mix and material totals, and system messages and real-time diagnostics.

One such system, the "Impulse Plant Management and Control System," is available from CMI Corporation in Oklahoma City, Okla. and is described in Publication ABX301, "CMI - IMPULSE Plant Management Control System Operation, Reference and Parts Manual." The present invention is an improvement in the "Impulse Plant Management and Control System," the improvement comprising the automatic control of the air to fuel ratios of burner combustion based on measurement of combustion exhaust emissions at different fuel settings.

SUMMARY OF THE INVENTION

In the burner of a hot mix asphalt plant, the content of the emissions is largely dependent upon the composition of the fuel and the air-fuel ratio of the combustion process. The quantity of the fuel must be controlled in the fuel supply before the fuel reaches the burner. The air-fuel ratio, however, is controlled by a mechanical linkage during the operation of the plant.

In the past, the air-fuel mixture was often adjusted according to a linear relationship. If the fuel needed to be increased, then the air supply was also increased by an amount to maintain the air-fuel mixture on a straight-line ratio. The same linear adjustment was made when the fuel was required to be decreased.

The optimal air-fuel relationship, however, has been found to be non-linear. As the amount of fuel in the combustion is varied, the quantity of air required for ideal combustion is more like a parabolic curve than a straight line. Thus, adjusting the air supply linearly with relation to the various fuel positions does not result in the most efficient combustion.

The present invention is a method and system for adjusting the air-fuel ratio of a burner in a non-linear fashion to produce efficient combustion at a preselected range of fuel settings. The benefits of the present invention are better fuel efficiency, lower plant maintenance resulting from cleaner combustion, improved plant operation, and exhaust emissions which contain smaller quantities of contaminants than could be achieved otherwise.

DETAILED DESCRIPTION OF THE PREFERRED EMBODIMENTS

A typical hot mix asphalt batch facility consists of two separate processes. The first process is drying the aggregate until the moisture content of the aggregate is approximately zero. The second process is mixing the dry aggregate and asphalt cement to produce the hot mix asphalt product.

In operation, aggregate is conveyed from feed bins to a dryer. The combustion in the dryer removes moisture from the aggregate. An exhaust fan draws the exhaust gases from the dryer through a dust collection system, which removes dust particles from the exhaust gas. Elevators transport the dry aggregate to the mixing tower.

The top of the mixing tower usually contains vibrating screens to screen out particles of aggregate which are not the desired size. After being weighed out in a weigh hopper, the screened aggregate and asphalt cement are both fed into a pug mill. The pug mill mixes the aggregate and asphalt cement such that the aggregate is coated with asphalt cement. The hot mix asphalt is then removed from the pug mill to trucks or storage silos.

Another type of asphalt plant is a drum mixer plant. In the drum mixer plant, the drying of the aggregate and the mixing of the hot aggregate and the asphalt cement are performed within the same drum, called a drum mixer. Thus the drum mixer takes the place of the dryer and the pug mill of the batch facility. The present invention may be utilized to control the combustion of the dryer in the batch plant or the drum mixer of the drum mixer facility.

Figures 1, 2:
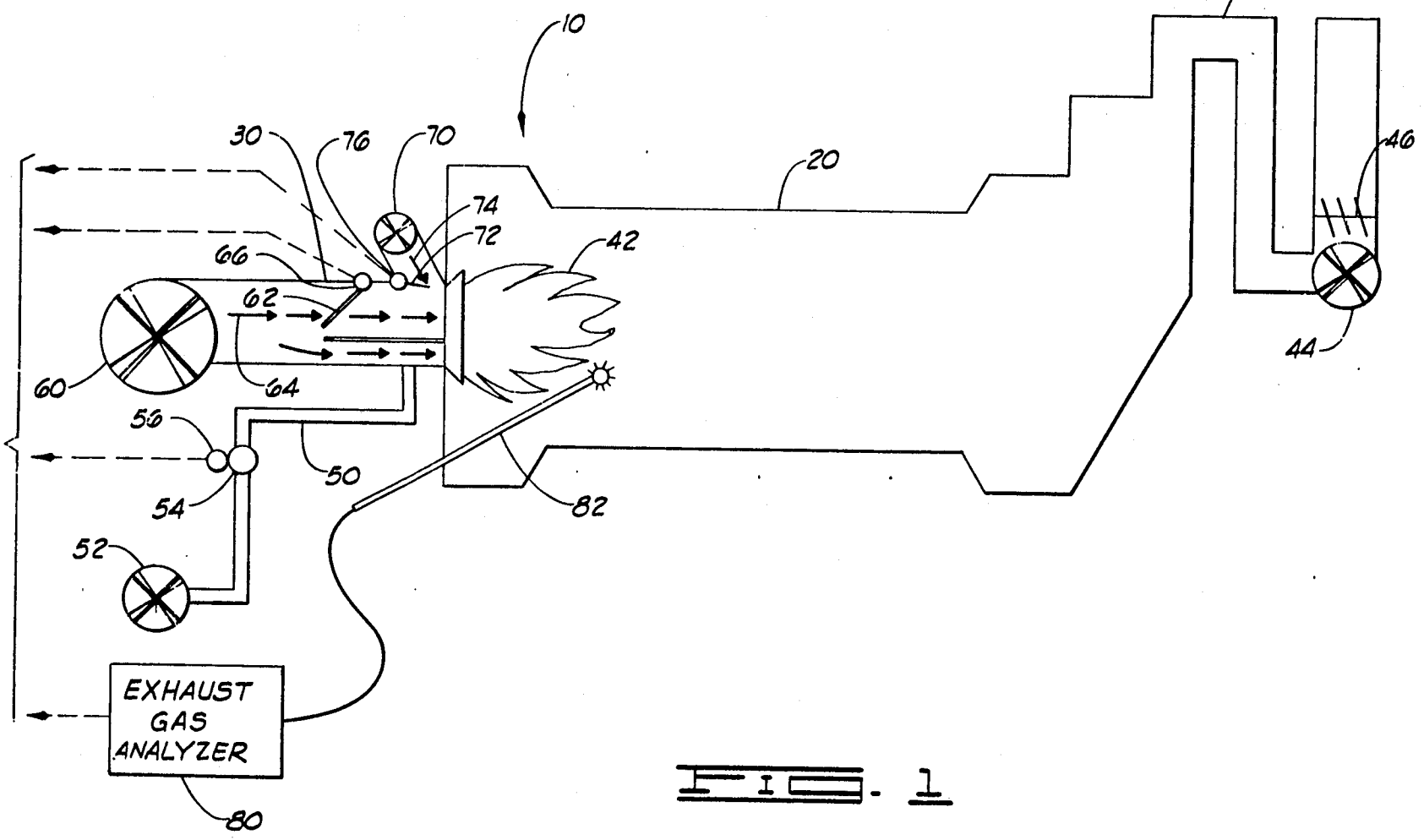
FIG. 1 is a diagram of a burner and drum assembled in accordance with the present invention.
FIG. 2 is a diagram of an electronic combustion control system assembled in accordance with the present invention.
Figure 2:
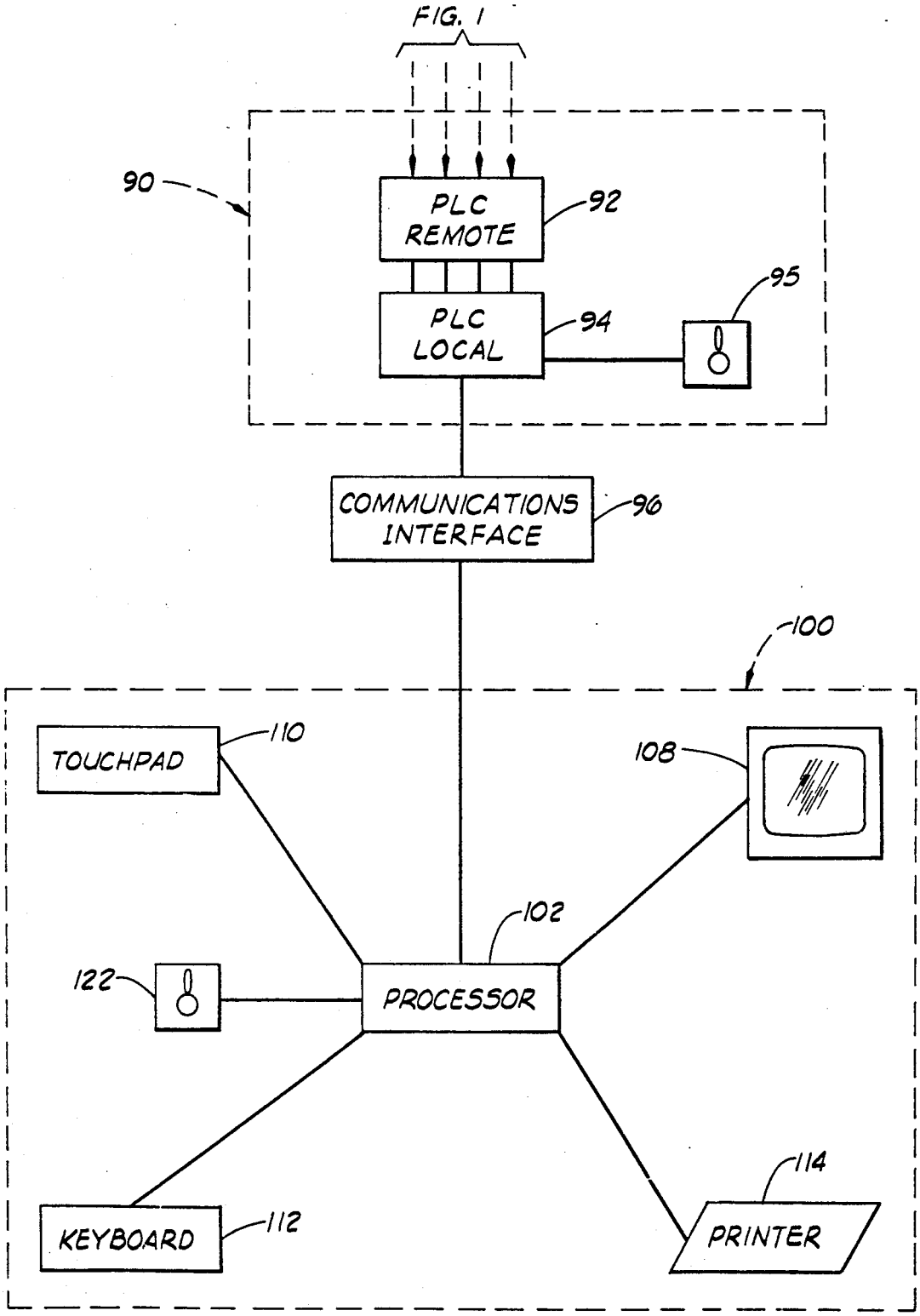

Referring now to FIG. 1, reference character 10 generally designates the combination of a drum 20, burner 30 and exhaust system 40 as may be found in a batch or drum mix plant. Drums 20 and exhaust systems 40 are available in a range of sizes and models from CMI Corporation, Oklahoma City, Okla. Various sizes of burners 30 may be used, depending on the production capacity required Typical burners 30 are the models SJP360, SJP520, SJP580 and SJP750 available from Hauck Manufacturing in Lebanon, Pa. The flame of the burner 30 is indicated by reference character 42.

The exhaust system 40 is connected to the drum 20 for the purpose of drawing exhaust gases of the combustion out of the drum 20 and through dust collection and pollution control equipment (not shown). An exhaust fan 44 provides a draft and a damper 46 controls the amount of the draft through the drum 20.

A fuel line 50 supplies fuel to the burner 30. A fuel pump 52 provides pressure to deliver the fuel to the burner 30. A fuel control valve 54 is located in the fuel line 50 to control the amount of fuel supplied to the burner 30.

A combustion air blower 60 is installed at the burner end of the drum 20 to supply air for combustion in the burner 30. A secondary air vane 62 is located in the air flow (indicated by the arrows 64) of the combustion air blower 60 in order to adjust the amount of air from the combustion air blower 60 supporting combustion in the burner 30. This component of air supplied to the burner 30 is called the secondary air, because it is secondary to the primary air that is mixed with the fuel in the burner nozzle.

A tertiary air blower 70 is installed in the burner end of the drum 20 as well, supplying additional air to the combustion in the burner 30. A tertiary air vane 72 is located in the air flow (indicated by the arrow 74) of the tertiary air blower 70 in order to control the amount of tertiary air reaching the combustion in the burner 30.

The Hauck burners are equipped with control motors (not shown) which change the settings of the components of the burner 30. For example, control motors adjust the operating positions of the fuel control valve 54, the secondary air vane 62 and the tertiary air vane 72.

Each control motor of the Hauck burner is attached to a valve-positioner/controller, such as the AP3200 device available from Action Instruments, Inc. in San Diego, Calif. A valve-positioner/controller typically positions a motorized valve relative to a slidewire or potentiometer feedback input.

Continuing to refer to FIG. 1, the valve-positioner 56 positions the fuel valve 54 the valve-positioner 66 positions the secondary air vane 62, and the valve-positioner 76 positions the tertiary air vane 72. Changes in positions are made on the basis of DC inputs received by the valve-positioner and the feedback slidewire of the control motor for the burner component in the usual fashion. The valve-positioners are connect by standard interface cables (indicated by dashed lines) to the electronic apparatus of the system.

In order to monitor the constituents of the products of combustion, an exhaust gas analyzer 80, is utilized. The Model P-100 gas analyzer available from the Thermox Division of AMETEK in Pittsburgh, Pa., is a suitable instrument. As shown in FIG. 1, the gas analyzer 80 has a probe 82 for sampling gases. The probe 82 is positioned such that the probe 82 is exposed to a representative sample of the constituent gases of the combustion exhaust.

As shown in FIG. 2, a programmable logic controller 90, often used in process control applications, is a system which has a user-programmable memory for storage of instructions to perform specific functions. The PLC-5/25 programmable controller from the PLC Division of Allen-Bradley Corporation in Highland Heights, Ohio, is a preferred product, although other programmable logic controllers with similar capabilities could be employed.

The programmable logic controller 90 includes a remote rack 92 and a local rack 94. The two racks 92 and 94 are connected by standard interfaces which are well-known in the art. The purpose of the remote rack 92 is to bring all cable terminations to a central point in the production area or energy center. The local rack 94 performs the same function in the control house. This configuration is typical of programmable logic controllers and greatly simplifies installation and modification of the equipment and cabling.

The programmable logic controller 90 has the capability to receive signals from sensing devices and to send signals to control devices. The programmable logic controller 90 receives information relating to the current operating positions of the valve-positioners 56, 66 and 76. The programmable logic controller 90 also sends signals to the valve-positioners 56, 66 and 76 to change operating positions of the fuel valve 54, the secondary air vane 62 and the tertiary air vane 72, respectively.

Applications software 95 available from CMI Corporation in Oklahoma City, Okla., provides the monitoring and control functions associated with the burner 30 and the asphalt plant. A copy of the CMI software 95 is hereby incorporated in the form of a microfiche appendix.

In order to communicate with the computer system 100, which is described hereinafter, the programmable logic controller 90 is connected to a communications interface 96. The function of the communications interface 96 is to convert the information format of the programmable logic controller 90 to a format which is usable by the computer system 100. For information travelling in the opposite direction, the communications interface 96 converts the information format of the computer system 100 to a format which can be utilized by the programmable logic controller 90. A preferred communications interface is the 1770-KF2 Communication Unit available from the PLC Division of Allen-Bradley Corporation in Highland Heights, Ohio, although other communications interfaces with comparable features could be used. The communications interface 96 and the programmable logic controller 90 are connected by standard interface cables with appropriate pin connections.

Turning now to the computer system, the processor 102 is an IBM/AT ® or IBM/AT ®-compatible 286 or 386 machine. The minimum configuration of the processor 102 is 640K memory, 20-MB hard disk drive, two serial and one parallel ports, VGA color graphics board, 12 megahertz or faster processor board, and a 5.25- or 3.5-inch floppy disk drive.

Preferably, a 13- to 19-inch video graphics adapter (VGA) color monitor 108 is attached by appropriate monitor cable to the processor 102. Any comparable monitor which is compatible with the other components of the computer system 100 could be utilized.

An Allen-Bradley Advisor PC Intelligent Control Panel (touch pad) 110 is also attached to the processor 102. Other touch pads with capabilities similar to the Allen-Bradley Advisor PC Intelligent Control Panel could be used. This device allows the user to customize touchpad keys to represent functions which are to be performed. In the present invention, the keys are defined to represent various burner and asphalt plant functions. One or more keys of the touchpad 110 are defined to access and execute the Electronic Combustion Control feature of the plant management control system. The definition of touchpad keys in this manner is well-known in the electronic process control industry.

A keyboard 112 and printer 114 are typically connected to the processor 102. The keyboard 112 can be used as an alternate or supplemental device to the touchpad 110 for entry of commands to the processor 102. Any keyboard which is compatible with the processor 102 can be used. The printer 114 is utilized to print a hard copy record of commands and alarms which arise in the operation of the plant. The Epson EX-800 color printer is typically used, but any comparable printer can be installed with the appropriate printer interface cable to the processor 102.

Allen-Bradley Advisor PC Series E release 5.0 is the systems software 122 providing the basic system functions and capability to format the screens for display on the video monitor 108. The video screens are designed and controlled by standard display management functions of the systems software 122.

Before the system is utilized in the production of asphalt, a burner calibration is performed. A number of fuel positions are selected as calibration points. The first calibration point is normally fuel position 0, indicating that no fuel is being supplied to the burner. The last calibration point is usually a fuel position of 100 percent, at which position the maximum amount of fuel is being delivered to the burner. The number of calibration points selected depends upon the fuel used, the characteristics of the components of the plant, and other design criteria. It is found that a total of seven to nine fuel positions are normally sufficient to provide air-fuel adjustments which result in acceptably efficient combustion.

Once the fuel positions for calibration are selected, the burner 30 is set at each of these fuel positions. With the fuel position held constant, the secondary air and the tertiary air are both varied while the exhaust gas analyzer 80 measures the combustion products. Through an analysis of the exhaust gas analyzer 80 data, optimal settings for the secondary air vane 62 and the tertiary air vane 72 for each fuel position are determined. The optimal settings are those where the undesirable emissions measured by the exhaust gas analyzer 80, typically the emissions of carbon monoxide, are a minimum.

The burner calibration process is repeated for each fuel position selected for calibration. The optimal secondary and tertiary air settings for each of these fuel positions are stored in the program logic controller 100 and the applications software 95. Once the fuel calibration is completed, the program logic controller 100 and the applications software 95 have the information required to control the combustion of the asphalt plant in production mode. It is normally not necessary to repeat the burner calibration process unless the fuel is changed, a burner component is altered to affect the combustion characteristics, or it is desired to change the number of calibration points. The exhaust gas analyzer 80 is utilized only during burner calibration and is not used when the plant is in asphalt production mode.

The table below illustrates the information used and displayed by the system in burner calibration and combustion control:

ELECTRONIC COMBUSTION CONTROL

| CALIBRATION POINTS: | C1 | C2 | C3 | C4 | C5 | C6 | C7 | C8 | C9 |
|---|---|---|---|---|---|---|---|---|---|
| FUEL POSITION: | 0 | 15 | 26 | 39 | 47 | 55 | 64 | 78 | 100 |
| SECONDARY AIR: | 10 | 33 | 46 | 61 | 77 | 100 | 100 | 100 | 100 |
| TERTIARY AIR: | 0 | 2 | 4 | 10 | 21 | 34 | 45 | 69 | 100 |

ALL POSITIONS ARE DISPLAYED IN PERCENT

When the plant is operating to produce asphalt, the program logic controller 100 and the applications software 95 force the secondary air vane 62 and tertiary air vane 72 to assume positions based upon the data of the burner calibration. Each time the position of the fuel valve 54 is changed, the program logic controller 100 and the applications software 95 determine appropriate secondary and tertiary air settings for the new fuel position.

Assume, for example, that the fuel position changes to 42 percent. Referring to the sample burner calibration table hereinabove, a fuel position of 42 percent falls between calibration points C4 and C5. The applications software 95 interpolates the calibration data to calculate the appropriate secondary and tertiary air settings. For a fuel position of 42 percent, typical values calculated might be 65 percent for secondary air and 14 percent for tertiary air.

After determining the appropriate air settings, the progammable logic controller 100 and the applications software 95 send signals to the valve-positioners 66 and 76 to move the secondary air vane 62 and tertiary air vane 72 to positions corresponding to the new air settings. The secondary air vane 62 and tertiary air vane 72 remain at the new air settings until another adjustment in air settings is required.

The operating positions of the fuel valve 54, the secondary air vane 62 and tertiary air vane 72 are communicated to the plant operator. The programmable logic controller 100 and applications software 95 send the information through the communications interface 96 to the processor 102. The processor 102 and the system software 122 cooperate to display the information to the plant operator on the video monitor 108 or the printer 118.

Many other advantages are built into the hardware and software of the computer system 100. Recordation of the materials used and costs in making the asphalt is one such benefit. Asphalt composition and cost information are computed and stored on the hard disk of the processor 102.

Abnormal conditions are displayed to the operator on the video monitor 108 and the printer 114. Diagnostic information to assist in correcting abnormal conditions is also displayed. The diagnostic information is displayed in easy-to-understand text which identifies components by the identifying tag which physically appears on the components.

In addition to combustion control, the system graphically displays virtually all functions of the asphalt plant operation. The video monitor 108 shows conveyor belts starting or stopping, blowers or pumps being turned off or on, and flames being ignited or extinguished.

The applications software 95 contains various "interlocks" which prevent the execution of a function unless all prerequisite conditions are met. For example, the applications software 95 does not allow starting the main flame unless a pilot flame is detected.

Because of the monitoring and data logging capability of the programmable logic controller 90, systems software 122 and applications software 95, a wide variety of information about the operation of the asphalt plant is made available.

Changes may be made in the combinations, operations and arrangements of the various parts and elements described herein without departing from the spirit and scope of the invention as defined in the following claims.

What is claimed is:

1. A method of achieving improved combustion in a hot mix asphalt plant having a drum, a burner and adjustable air flow to combustion of the burner, the steps of the method comprising:

(a) calibrating the burner, the steps of calibrating the burner comprising:

(1) selecting a plurality of fuel positions for the burner;

(2) inserting an exhaust gas analyzer probe into the drum proximate to combustion of the burner, the exhaust gas analyzer probe being connected to an exhaust gas analyzer to provide an analysis of the constituents of the combustion products of the burner;

(3) varying the air flow to the combustion of the burner for a plurality of air settings at each fuel position of the burner; and (4) determining an optimal air setting for each fuel position of the burner by comparing the analysis of the constituents of the combustion products for each air setting for each fuel position; and (b) controlling the air flow to the combustion of the burner during operation of the plant to produce asphalt, the steps of controlling air flow comprising:

(1) monitoring the fuel position of the burner for changes in the selected fuel position; and (2) adjusting the air flow to the combustion of the burner to the optimal air setting for the selected fuel position of the burner in response to the changes in the selected fuel position.

2. The method of claim 1 further comprising the step of:

removing the exhaust gas analyzer probe from the drum between steps (a) and (b).

3. The method of claim 1 wherein the optimal air setting for each fuel position is determined to be the air setting corresponding to the exhaust gas analysis of the constituents of combustion products containing the least amount of carbon monoxide.

4. The method of claim 1 wherein the monitoring of the fuel position of the burner and the adjusting of the air flow is directed by a programmable controller.

5. The method of claim 1 further comprising the step of:

displaying the fuel position of the burner and the air setting of the air flow.

6. In a hot mix asphalt production plant, the combination comprising:

a drum;

burner means attached to the drum and having combustion for drying aggregate moving through the drum, the burner means including a fuel line for providing a supply of fuel to the burner means;

a fuel control valve installed in the fuel line to adjust the supply of fuel to the combustion of the burner means, the fuel control valve having a plurality of fuel positions, each fuel position corresponding to a preselected amount of fuel being supplied to the burner means;

blower means, attached to the drum, for providing a supply of air to the combustion of the burner means;

air control means, attached to the blower means and having a plurality of predetermined air settings, for adjusting the supply of air to the combustion of the burner means, each air setting corresponding to a predefined amount of air being supplied into the drum; and an exhaust system attached to the drum and receiving products of combustion produced by the burner means;

electronic means, connected to the fuel control valve and the air control means and being programmed with a predetermined optimal air setting corresponding to each fuel position, for causing the air control means to assume the corresponding optimal air setting whenever the fuel control valve is changed to another one of the fuel positions.

7. The apparatus of claim 6 wherein the blower means comprises:

a combustion air blower having a secondary air flow to the combustion of the burner means; and a tertiary air blower having a tertiary air flow to the combustion of the burner means.

8. The apparatus of claim 7 wherein the air control means comprises:

a secondary air vane located in the secondary air flow and movable between a plurality of operating positions, each operating position of the secondary air vane defining a secondary air setting; and a tertiary air vane located in the tertiary air flow and movable between a plurality of operating positions, each operating position of the tertiary air vane defining a tertiary air setting.

9. The apparatus of claim 6 wherein the electronic means is further characterized to include:

a fuel valve positioner connected to the fuel control valve, the fuel valve positioner having an output corresponding to each of the fuel positions of the fuel control valve;

a programmable controller connected to the fuel valve positioner and the air control means, the programmable controller signalling the air control means to adjust air flow to the predetermined optimal air setting for the corresponding fuel position in response to the output of the fuel valve positioner; and a computer system connected to the programmable controller, the computer system having data means for receiving and storing information from the programmable controller and display means for showing information related to the fuel positions and air settings.

* * * * *